US010894188B2

(12) United States Patent
Madson et al.

(10) Patent No.: US 10,894,188 B2
(45) **Date of Patent: *Jan. 19, 2021**

(54) GOLF BALL DIMPLE PATTERNS INCLUDING STARS AND STRIPES AND COLOR

(71) Applicant: Acushnet Company, Fairhaven, MA (US)

(72) Inventors: Michael R. Madson, Easton, MA (US); William E. Morgan, Rehoboth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/710,178

(22) Filed: Dec. 11, 2019

(65) Prior Publication Data

US 2020/0108297 A1 Apr. 9, 2020

Related U.S. Application Data

(63) Continuation-in-part of application No. 16/044,644, filed on Jul. 25, 2018, now Pat. No. 10,532,251.

(51) Int. Cl.
*A63B 37/00* (2006.01)
*A63B 37/14* (2006.01)

(52) U.S. Cl.
CPC ..... *A63B 37/0006* (2013.01); *A63B 37/002* (2013.01); *A63B 37/0009* (2013.01); *A63B 37/0011* (2013.01); *A63B 37/0018* (2013.01); *A63B 37/0019* (2013.01); *A63B 37/0022* (2013.01); *A63B 37/0012* (2013.01)

(58) Field of Classification Search
CPC ..... A63B 37/0006; A63B 37/0009; A63B 37/0011; A63B 43/008
USPC ..... 473/365, 378, 383
See application file for complete search history.

(56) References Cited

U.S. PATENT DOCUMENTS

| | | | | |
|---|---|---|---|---|
| 7,033,285 | B2 | 4/2006 | Sato et al. | |
| 8,033,933 | B2 * | 10/2011 | Sullivan | A63B 37/0009 473/384 |
| 8,308,587 | B1 * | 11/2012 | Morgan | A63B 37/0003 473/378 |
| 8,329,081 | B2 | 12/2012 | Morgan et al. | |
| 8,915,802 | B2 | 12/2014 | Morgan | |
| 8,915,803 | B2 | 12/2014 | Hogge et al. | |
| 9,056,223 | B2 | 6/2015 | Hogge et al. | |
| 9,056,224 | B2 | 6/2015 | Morgan | |
| 9,199,127 | B2 | 12/2015 | Hogge et al. | |
| 9,339,843 | B2 | 5/2016 | Kuntimaddi et al. | |
| 9,421,423 | B2 | 8/2016 | Umemura et al. | |
| 10,532,251 | B1 * | 1/2020 | Madson | A63B 1/00 |
| 2004/0127306 | A1 * | 7/2004 | Sato | A63B 37/0009 473/383 |

(Continued)

FOREIGN PATENT DOCUMENTS

| | | | | |
|---|---|---|---|---|
| KR | 20130127183 | * 11/2013 | ..... | A63B 37/0022 |
| KR | 20170045844 | 4/2017 | | |

*Primary Examiner* — John E Simms, Jr.
(74) *Attorney, Agent, or Firm* — Margaret C. Barker

(57) ABSTRACT

The present invention provides golf balls having a pattern of stellated polygon shaped dimples and grooves with preselected and coordinated color appearances on the outer surface of the ball to produce a unique and desirable overall golf ball color appearance.

20 Claims, 9 Drawing Sheets

(56) References Cited

U.S. PATENT DOCUMENTS

| | | | | |
|---|---|---|---|---|
| 2009/0017941 | A1* | 1/2009 | Sullivan | A63B 37/0011 473/383 |
| 2009/0137343 | A1 | 5/2009 | Morgan et al. | |
| 2010/0317464 | A1* | 12/2010 | Nakagawa | A63B 37/0003 473/378 |
| 2012/0028726 | A1* | 2/2012 | Aittola | A63B 37/0003 473/280 |
| 2012/0183691 | A1* | 7/2012 | Kuntimaddi | B05D 5/06 427/259 |
| 2013/0130841 | A1* | 5/2013 | Morgan | A63B 37/0018 473/378 |
| 2014/0066229 | A1* | 3/2014 | Kuntimaddi | B05B 12/20 473/378 |
| 2014/0073462 | A1* | 3/2014 | Morgan | A63B 37/0022 473/378 |
| 2014/0200099 | A1* | 7/2014 | Aoyama | A63B 37/0021 473/383 |
| 2014/0250609 | A1* | 9/2014 | Tutmark | D06P 3/26 8/495 |
| 2015/0057106 | A1* | 2/2015 | Kishishita | A63B 37/0019 473/384 |
| 2015/0283430 | A1* | 10/2015 | Dykas | A63B 43/008 473/378 |
| 2016/0158605 | A1 | 6/2016 | Morgan et al. | |

* cited by examiner

GOLF BALL DIMPLE PATTERNS INCLUDING STARS AND STRIPES AND COLOR

CROSS REFERENCE TO RELATED APPLICATIONS

This application is a continuation-in part of co-pending U.S. patent application Ser. No. 16/044,644, filed on Jul. 25, 2018, which is hereby incorporated herein in its entirety.

FIELD OF THE INVENTION

This invention relates to golf balls having a novel dimple pattern that includes stellated polygon shaped dimples and grooves and incorporating a variation of colors therein to visually enhance the unique attributes of the dimple pattern.

BACKGROUND OF THE INVENTION

The pattern of the dimples on the outer surface of a golf ball contributes significantly to the flight characteristics of the ball. Thus, many golf ball manufacturers conduct extensive dimple research, which is often focused on improving the aerodynamic forces on the ball during flight and increasing the distance traveled by the ball.

Dimple patterns also contribute to the aesthetics of a golf ball. Thus, for certain purposes, it may be desirable to provide a golf ball with an aesthetically unique dimple pattern. Thus, various decorative dimple patterns have been introduced. For example, U.S. Pat. No. 7,033,285 to Sato discloses a golf ball surface design including star-shaped ridges.

Despite the many dimple patterns disclosed in the prior art, there has been no disclosure of a golf ball having a dimple pattern as provided by the present invention.

SUMMARY OF THE INVENTION

The present invention is directed to a golf ball having a plurality of dimples and a plurality of grooves on the outer surface thereof. The outer surface of the golf ball can be divided by a plane that passes through the geometric center of the golf ball and divides the outer surface into a first hemisphere and a second hemisphere.

In one embodiment, the first hemisphere comprises at least 40 dimples having a stellated polygon plan shape, and the second hemisphere comprises at least 5 grooves.

In another embodiment, the first hemisphere has an arrangement of dimples and grooves comprising 50 dimples having a stellated polygon plan shape and 6 grooves, and the second hemisphere has an arrangement of dimples and grooves that is substantially identical to the arrangement of the first hemisphere.

Advantageously, in different embodiments, a golf ball of the invention has a novel overall golf ball color appearance that is produced by pre-selecting and coordinating color appearances for each of dimples, grooves and land surfaces of the two hemispheres of golf balls of the invention. In one embodiment, a golf ball of the invention has a plurality of dimples and a plurality of grooves on the outer surface thereof, wherein the outer surface may be divided by a dividing plane that passes through the geometric center of the golf ball and divides the outer surface into a first hemisphere and a second hemisphere. The first hemisphere may comprise at least 40 dimples having a stellated polygon plan shape, and not including any grooves; and the second hemisphere may comprise at least 5 grooves, and not including any dimples having a stellated polygon plan shape.

Additionally, the land surface of the first hemisphere has a first color appearance that contributes to an overall golf ball color appearance, and the land surface of the second hemisphere has a second color appearance that also contributes to the overall golf ball color appearance. Meanwhile, each dimple of the first hemisphere has a third color appearance that contributes to the overall golf ball color appearance; and each groove of the second hemisphere has a fourth color appearance that contributes to the overall golf ball color appearance. The overall golf ball color appearance of the finished golf ball is therefore comprised of the first color appearance, the second color appearance, the third color appearance and the fourth color appearance.

In one such embodiment, the first color appearance is different than the second color appearance. In a specific such embodiment, the first color appearance may be blue-colored, and the second color appearance may be red-colored.

In a particular such embodiment, each of the third color appearance and the fourth color appearance may be different than both of the first color appearance and second color appearance. In a specific such embodiment, each of the third color appearance and the fourth color appearance is white.

In another particular such embodiment, the third color appearance is the same as the second color appearance, and the fourth color appearance is the same as first color appearance.

In a different embodiment, the first color appearance may be the same as the second color appearance. In one such specific embodiment, the third color appearance is different than the first color appearance. In another such specific embodiment, the third color appearance is the same as the second color appearance, and the fourth color appearance is the same as first color appearance. In yet another such specific embodiment, the fourth color appearance is different than second color appearance. These specific embodiments are mutually exclusive of each other.

In still another such embodiment, each of the third color appearance and the fourth color appearance is different than both of the first color appearance and the second color appearance.

In a particular embodiment, the at least one of the color appearances creating the overall golf ball color appearance comprises a colored coating that is painted on the first hemisphere and/or second hemisphere.

In another particular embodiment, each of the grooves has a plan shape defined by a curved path.

In yet another particular embodiment, each of the dimples having a stellated polygon plan shape has an encompassing diameter of from 0.20 inches to 0.35 inches.

In still another particular embodiment, each of the dimples having a stellated polygon plan shape has a ratio, $$\frac{D1}{D2},$$

of the encompassing diameter, D1, to the interior diameter, D2, of from 2 to 5.

In one preferred embodiment, each of the grooves has a depth of from 0.007 inches to 0.017 inches, as measured along a ball radius from the phantom surface of the ball to the deepest point of the groove.

Alternatively, a golf ball of the invention may have a plurality of dimples and a plurality of grooves on the outer surface thereof, wherein the outer surface can be divided by a dividing plane that passes through the geometric center of the golf ball and divides the outer surface into a first hemisphere and a second hemisphere having the following properties: the first hemisphere has an arrangement of dimples and grooves comprising 50 dimples having a stellated polygon plan shape and 6 grooves, wherein the dimples and grooves do not overlap or touch, and the second hemisphere has an arrangement of dimples and grooves that is substantially identical to the arrangement of the first hemisphere. Additionally, the land surface of the first hemisphere has a first color appearance that contributes to an overall golf ball color appearance and the land surface of the second hemisphere has a second color appearance that contributes to the overall golf ball color appearance; and each dimple of the first hemisphere has a third color appearance that contributes to the overall golf ball color appearance, and each dimple of the second hemisphere has a fourth color appearance that contributes to the overall golf ball color appearance; and each groove of the first hemisphere has a fifth color appearance that contributes to the overall golf ball color appearance, and each groove of the second hemisphere has a sixth color appearance that contributes to the overall golf ball color appearance. The overall golf ball color appearance of the finished golf ball is therefore comprised of the first color appearance, the second color appearance, the third color appearance, the fourth color appearance, the fifth color appearance and the sixth color appearance.

In one such embodiment, the first color appearance is the same as the second color appearance. In another such embodiment, the first color appearance is different than the second color appearance. In yet another such embodiment, the third color appearance is the same as the fourth color appearance. In still another such embodiment, the fifth color appearance is the same as the sixth color appearance.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1A:
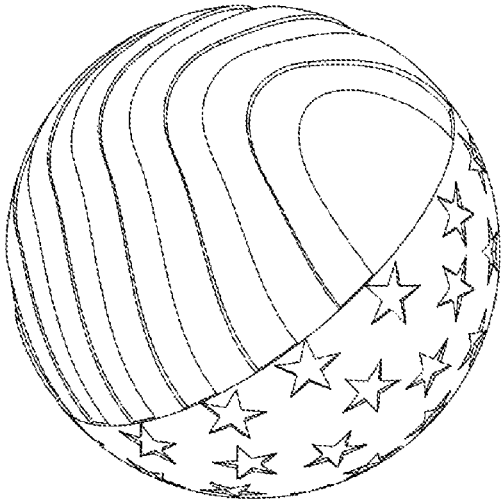
FIGS. 1A-1C illustrate plan views of a golf ball having a dimple pattern according to one embodiment of the present invention.
Figure 1B:
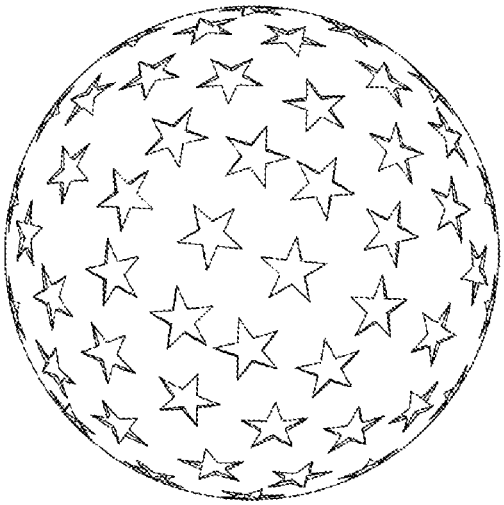
Figure 1C:
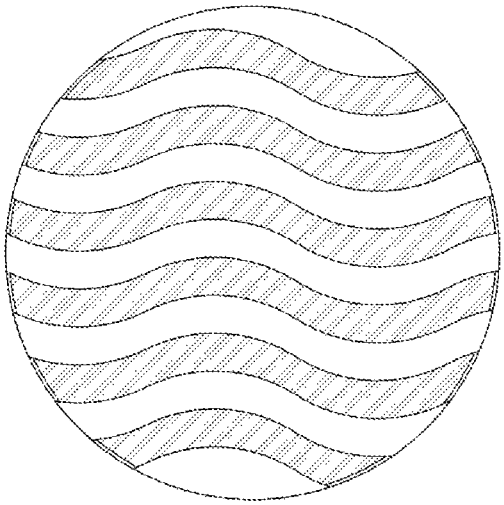
Figure 2A:
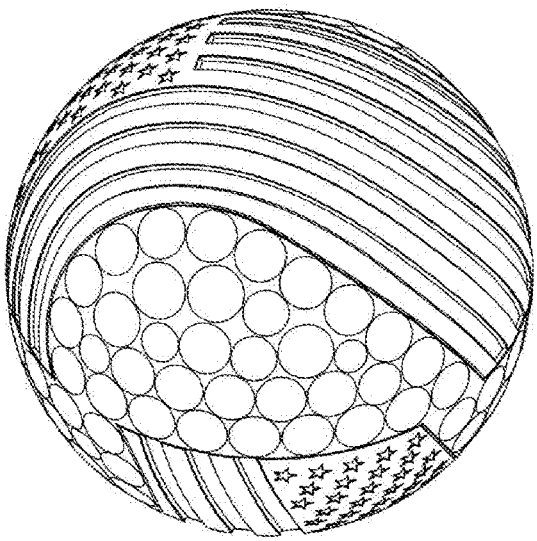
FIG. 2A-2C illustrate plan views of a golf ball having a dimple pattern according to another embodiment of the present invention.
Figure 2B:
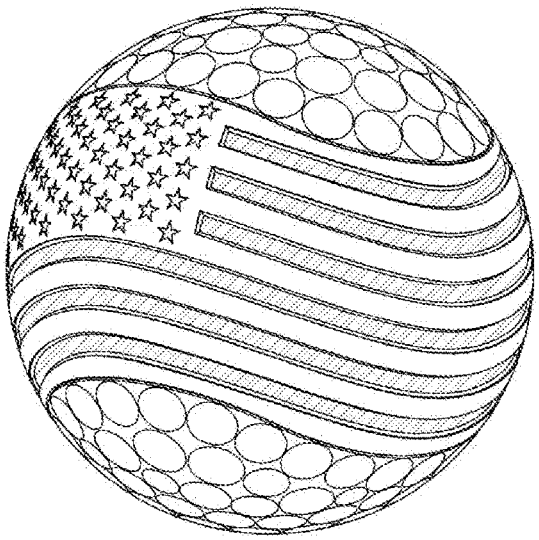
Figure 2C:
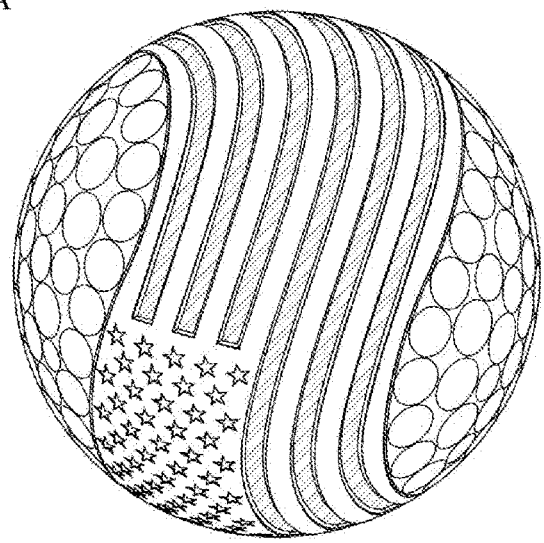

The present invention is directed to golf balls having a novel pattern of stellated polygon shaped dimples and grooves on the outer surface thereof bearing a resemblance to the American flag and wherein color appearance of dimples, grooves and land surfaces of the golf ball are pre-selected and coordinated to create pre-determined unique overall golf ball color appearance in the resulting ball. The outer surface of the ball is divided by a plane that passes through the geometric center of the golf ball and divides the outer surface into two hemispheres. The dividing plane may be, but is not necessarily, equivalent to the plane that is considered by those of ordinary skill in the art to be the equator of the ball. In one embodiment, as illustrated in FIGS. 1A-1C, one hemisphere of the ball consists of stellated polygon shaped dimples and the other hemisphere consists of grooves. In another embodiment, as illustrated in FIGS. 2A-2C, the ball includes two identical hemispheres, each hemisphere including stellated polygon shaped dimples and grooves.

Stellated Polygon ("Star") Shaped Dimples

Dimple patterns of the present invention include dimples having a plan shape defined by a stellated polygon. Such dimples are referred to herein as "stellated polygon shaped dimples" and "star shaped dimples." In a particular embodiment, star shaped dimples of the present invention have a plan shape defined by a stellated polygon having 4 or 5 or 6 points. In another particular embodiment, star shaped dimples of the present invention have a plan shape defined by a stellated pentagon.

Figure 3:
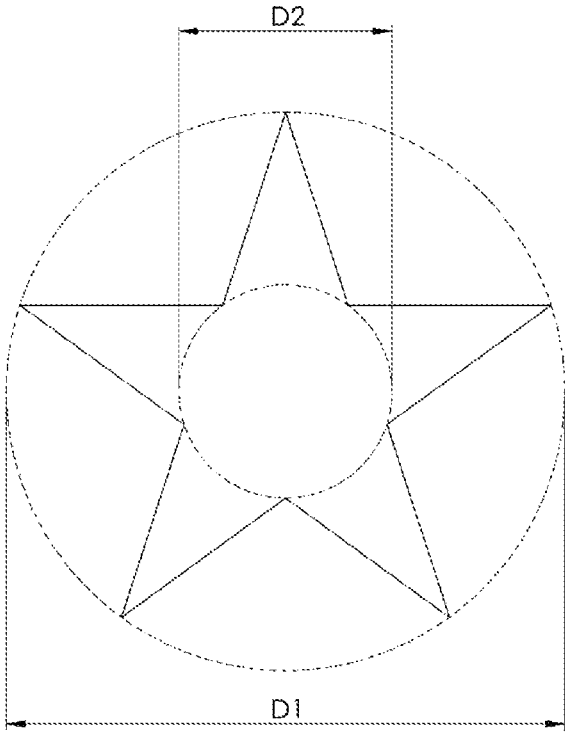
FIG. 3 illustrates a plan view of a stellated polygon shaped dimple according to an embodiment of the present invention.

As shown in FIG. 3, star shaped dimples of the present invention have an encompassing diameter, D1, and an interior diameter, D2. The encompassing diameter, D1, is preferably from 0.05 inches to 0.35 inches. The ratio, $$\frac{D1}{D2},$$

or the encompassing ammeter, D1, to the interior diameter, D2, is preferably 2 or 3 or 4 or 5, or is within a range having a lower limit and an upper limit selected from these values. The plan shape area, $A_p$, as measured in a plane normal to the axis connecting the plan shape centroid and the ball centroid, is preferably from $6.0\times10^{-4}$ in$^2$ to 0.0350 in$^2$.

In a particular embodiment, the dimple pattern of the present invention includes a group of at least three star shaped dimples arranged within relatively close proximity to each other, and preferably in a hexagonal manner, wherein, within the group of relatively closely spaced star shaped dimples, the centroid of at least one star shaped dimple does not lie in the same plane as two other star shaped dimples.

Figure 4:
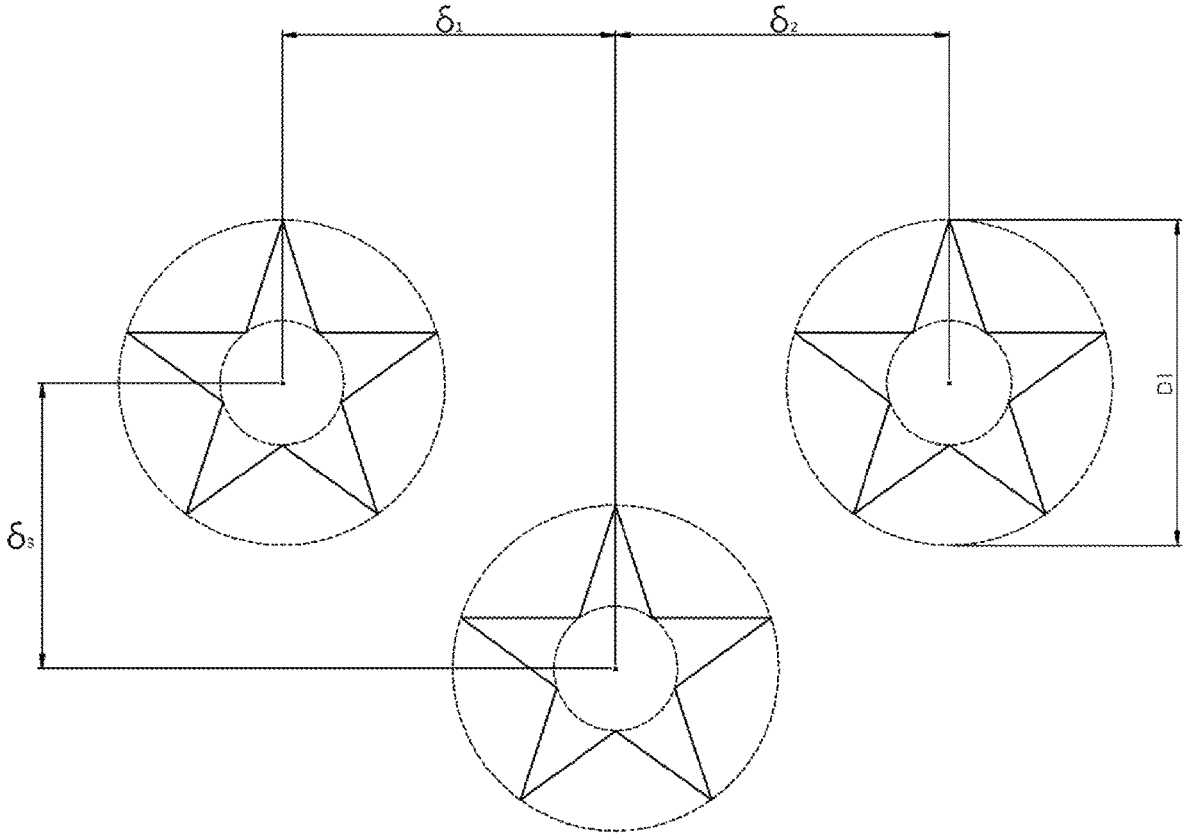
FIG. 4 illustrates a group of three stellated polygon shaped dimples according to an embodiment of the present invention.

For example, FIG. 4 shows a group of three star shaped dimples having the same encompassing diameter, D1, and separated by distances $\delta_1$, $\delta_2$, and $\delta_3$. The ratio, $$\frac{D1}{\delta 1},$$

or the encompassing ammeter, D1, to distance $\delta_1$ is preferably 0.75 or 0.90 or 1.00 or 1.25, or is within a range having a lower limit and an upper limit selected from these values. The ratio, $$\frac{D1}{\delta 2},$$

of the encompassing diameter, D1, to distance $\delta_2$ is preferably 0.75 or 0.90 or 1.00 or 1.25, or is within a range having a lower limit and an upper limit selected from these values. The ratio, $$\frac{D1}{\delta 3},$$

of the encompassing diameter, D1, to distance $\delta_3$ is preferably 0.90 or 1.10 or 1.20 or 1.40, or is within a range having a lower limit and an upper limit selected from these values. Preferably, the difference between $\delta_1$ and $\delta_2$ is from 0 to 0.005 inches.

Figure 5A:
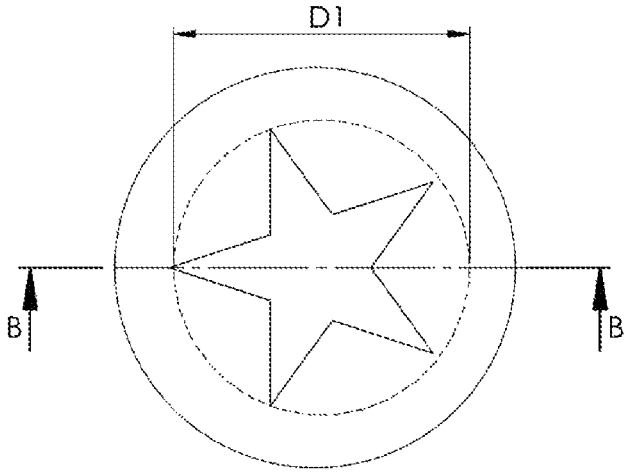
FIG. 5A illustrates a plan view of a stellated polygon shaped dimple according to an embodiment of the present invention.
Figure 5B:
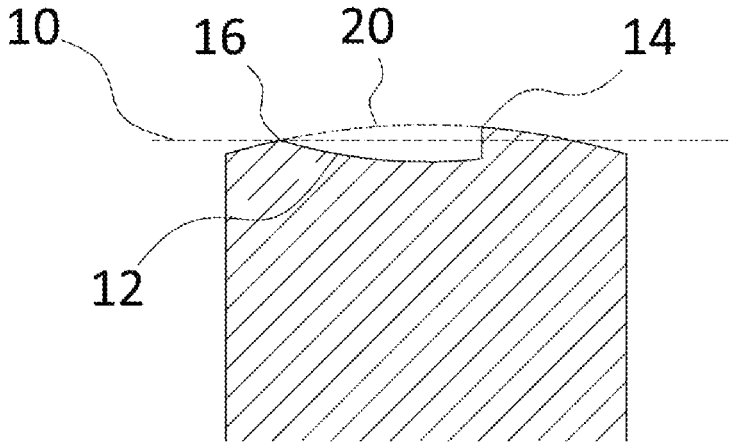
FIG. 5B is a profile view of the dimple of FIG. 5A taken along line B-B.

The profile of star shaped dimples of the present invention is preferably selected from arcuate (i.e., spherical), catenary, flat bottom, and constant depth profiles. An illustrative example of a star shaped dimple of the present invention having an arcuate dimple profile is shown in FIGS. 5A-5B. FIG. 5A shows a plan view of the dimple. FIG. 5B shows a profile view of the dimple of FIG. 5A taken along line B-B. All of the exterior vertices of the stellated polygon lie on the same encompassing diameter plane 10. The phantom ball surface 20 is the part of the ball surface that would exist if the dimple were not present. In the embodiment shown in FIGS. 5A-5B, the dimple profile 12 is defined by an arc having a starting point located at an exterior vertex 16 of the stellated polygon. Optionally, the arc starting point is offset from the dimple surface by a depth of up to 0.0050 inches. Also shown in FIG. 5B is the point 14 where an interior vertex of the stellated polygon connects to the ball surface. All of the interior vertices of the stellated polygon lie on the same interior diameter plane. Star shaped dimples of the present invention having an arcuate dimple profile preferably have an edge angle, as measured at the exterior vertices of the stellated polygon, of from 11.0° to 17.0°. Star shaped dimples of the present invention having an arcuate dimple profile preferably have a dimple depth, as measured along a ball radius from the phantom surface of the ball to the deepest point on the dimple, of from 0.005 inches to 0.025 inches.

Figure 6A:
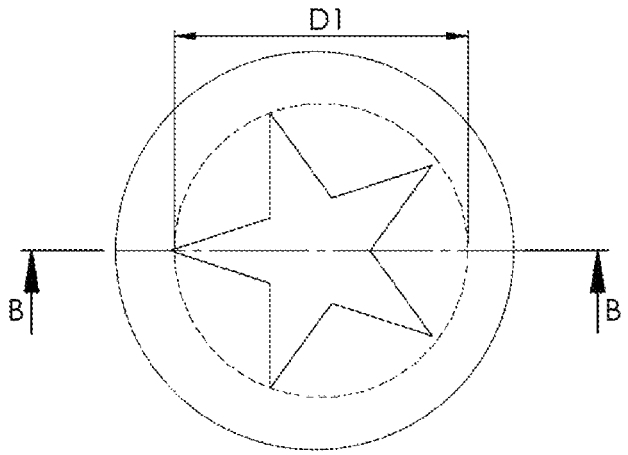
FIG. 6A illustrates a plan view of a stellated polygon shaped dimple according to another embodiment of the present invention.
Figure 6B:
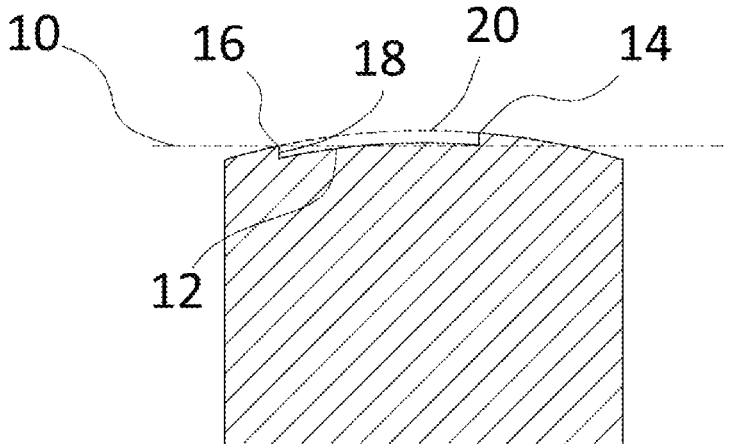
FIG. 6B is a profile view of the dimple of FIG. 6A taken along line B-B.

An illustrative example of a star shaped dimple of the present invention having a constant depth dimple profile is shown in FIGS. 6A-6B. FIG. 6A shows a plan view of the dimple. FIG. 6B shows a profile view of the dimple of FIG. 6A taken along line B-B. All of the exterior vertices of the stellated polygon lie on the same encompassing diameter plane 10. The phantom ball surface 20 is the part of the ball surface that would exist if the dimple were not present. In the embodiment shown in FIGS. 6A-6B, the dimple profile 12 is defined by an arc that is concentric with the dimple surface such that is creates a sidewall 18 at all points along the dimple perimeter. Star shaped dimples of the present invention having a constant depth dimple profile have a dimple depth, as measured along a ball radius from the phantom surface of the ball to the deepest point on the dimple, of from 0.003 inches to 0.015 inches.

Figure 7A:
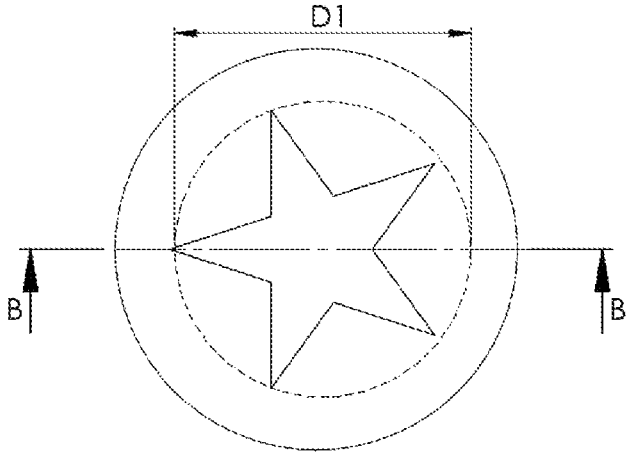
FIG. 7A illustrates a plan view of a stellated polygon shaped dimple according to another embodiment of the present invention.
Figure 7B:
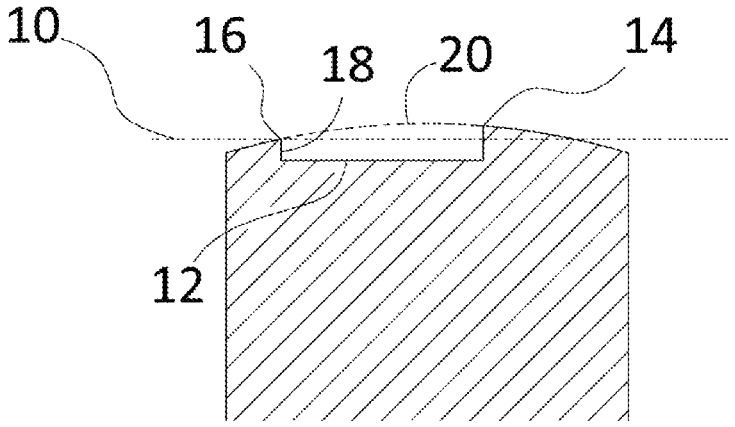
FIG. 7B is a profile view of the dimple of FIG. 7A taken along line B-B.

An illustrative example of a star shaped dimple of the present invention having a flat bottom dimple profile is shown in FIGS. 7A-7B. FIG. 7A shows a plan view of the dimple. FIG. 7B shows a profile view of the dimple of FIG. 7A taken along line B-B. All of the exterior vertices of the stellated polygon lie on the same encompassing diameter plane 10. The phantom ball surface 20 is the part of the ball surface that would exist if the dimple were not present. In the embodiment shown in FIGS. 7A-7B, the bottom of the dimple is flat, creating a sidewall 18 at all points along the dimple perimeter. In the embodiment shown in FIGS. 7A-7B, the bottom of the dimple is equidistant from the encompassing diameter plane 10 at all points. Star shaped dimples of the present invention having a flat bottom dimple profile have a dimple depth, as measured along a ball radius from the phantom surface of the ball to the deepest point on the dimple, of from 0.005 inches to 0.025 inches.

Figure 8:
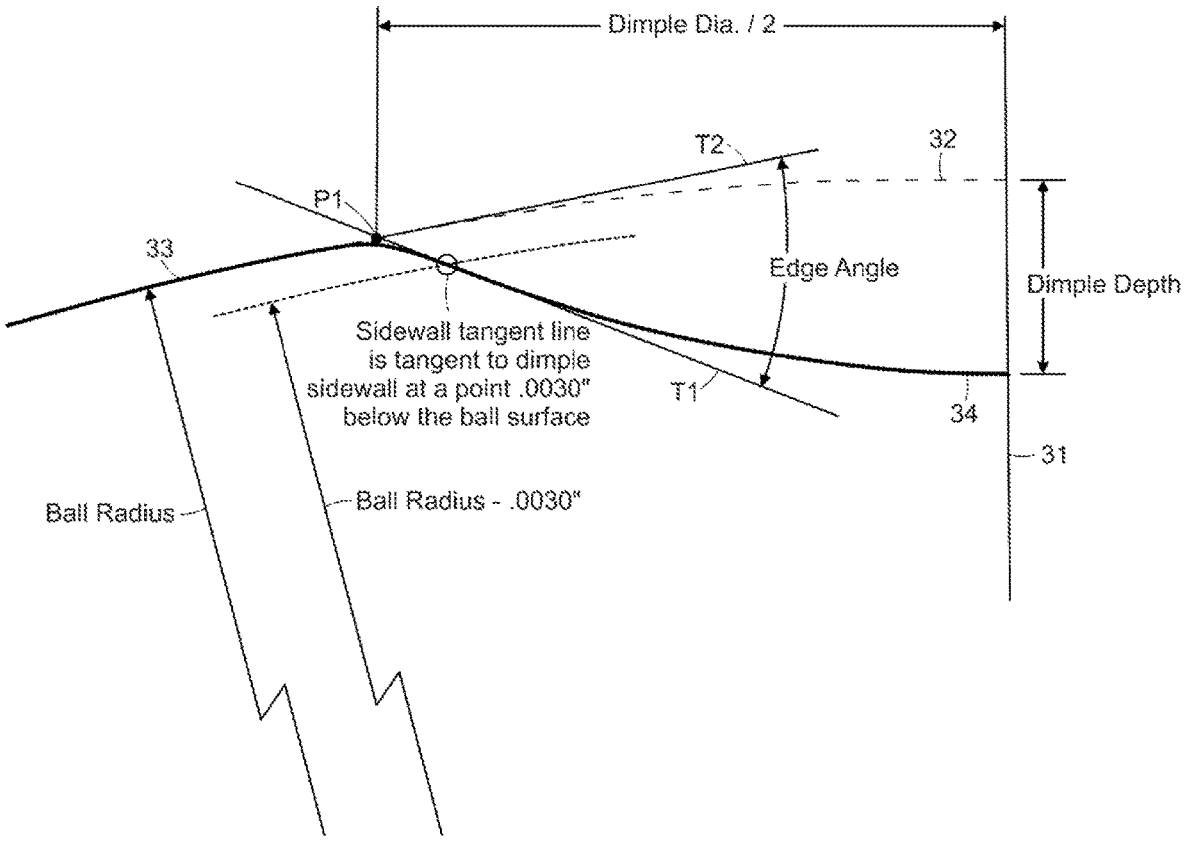
FIG. 8 is a schematic diagram illustrating a method for measuring the diameter of a dimple.

For purposes of the present disclosure, edge angle measurements are determined on finished golf balls. Generally, it may be difficult to measure an edge angle due to the indistinct nature of the boundary dividing the dimple from the ball's undisturbed land surface. Due to the effect of coatings on the golf ball surface and/or the dimple design itself, the junction between the land surface and the dimple is typically not a sharp corner and is therefore indistinct. This can make the measurement of properties such as edge angle ($\Phi_{EDGE}$) and dimple diameter, somewhat ambiguous. To resolve this problem, edge angle ($\Phi_{EDGE}$) on a finished golf ball is measured as follows, in reference to FIG. 8. FIG. 8 shows a dimple half-profile extending from the dimple centerline 31 to the ball's undisturbed land surface 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle ($\Phi_{EDGE}$) is the angle between T1 and T2.

Grooves

Dimple patterns of the present invention include grooves, preferably resembling stripes on the American flag. The profile of grooves of the present invention is preferably selected from arcuate, flat bottom, and constant depth profiles. Suitable profile shapes for grooves of the present invention include those disclosed in U.S. Pat. No. 9,707,451, the entire disclosure of which is hereby incorporated herein by reference. Preferably, the depth of the grooves is from 0.001 inches to 0.020 inches, as measured along a ball radius from the phantom surface of the ball to the deepest point of the groove. Preferably, the width of the grooves is from 0.05 inches to 0.35 inches. The width of a single groove can be constant along the length of the groove, or the width of a single groove can vary by up to 0.15 inches along the length of the groove. The plan shape of the grooves of the present invention can be defined by a straight line or a curved path. In a particular embodiment, each groove is separated by land area that is about the same width as, i.e., within 25% of, the width of the grooves adjacent to it.

In a particular embodiment, at least one groove terminates at the parting line of the golf ball at both ends of the groove.

Each groove has two long edges that meet the fret surface of the golf ball. In a particular embodiment, the maximum groove length on the ball, as measured by the groove edge with the longest length, is 2.00 inches or greater.

Non-limiting Illustrative Dimple Patterns

In one embodiment, the outer surface of the ball is divided by a plane that passes through the geometric center of the golf ball and divides the outer surface into a first hemisphere and a second hemisphere, wherein the first hemisphere has an arrangement of star shaped dimples and/or grooves, the second hemisphere has an arrangement of star shaped dimples and/or grooves, and the arrangement of star shaped dimples and/or grooves on the first hemisphere is different from that on the second hemisphere.

In a particular aspect of this embodiment, the first hemisphere comprises star shaped dimples in an amount of at least 40, or from 40 to 60. In a more particular aspect of this embodiment, the first hemisphere comprises 50 star shaped dimples. The first hemisphere optionally includes one or more dimples having a conventional plan shape, e.g., a circular plan shape, in addition to the star shaped dimples.

In another particular aspect of this embodiment, the second hemisphere comprises grooves in an amount of at least 5, or from 5 to 10. In a more particular aspect of this embodiment, the second hemisphere comprises 6 grooves. The second hemisphere optionally includes one or more dimples having a conventional plan shape, e.g., a circular plan shape, in addition to the grooves.

Referring now to FIGS. 1A-1C, a golf ball outer surface is illustrated having a first hemisphere consisting of 50 star shaped dimples and a second hemisphere consisting of 6 grooves, the grooves being represented by shading in FIG. 1C. Each of the star shaped dimples of the first hemisphere has a plan shape defined by a stellated pentagon, an encompassing diameter of 0.240 inches, and a plan shape area of 0.016 $in^2$. Each of the star shaped dimples of the first hemisphere has an arcuate profile shape, an edge angle of 16.0° at the exterior vertices of the stellated pentagon, and a dimple depth, as measured along a ball radius from the phantom surface of the ball to the deepest point on the dimple, of 0.0168 inches. Each of the grooves of the second hemisphere has a plan shape defined by a curved path, and are separated from each other by land area that is similar in width to the grooves. The width of each groove varies along the length of the groove. In a further particular aspect of the embodiment shown in FIGS. 1A-1C, the grooves of the second hemisphere have properties as given in Table 1 below.

TABLE 1

| Groove | Profile Shape | Depth (in) | Max Width (in) | Min Width (in) | First Edge Length (in) | Second Edge Length (in) |
|---|---|---|---|---|---|---|
| 1 | constant depth | 0.012 | 0.260 | 0.123 | 1.69 | 2.10 |
| 2 | constant depth | 0.012 | 0.156 | 0.125 | 2.36 | 2.54 |
| 3 | constant depth | 0.012 | 0.133 | 0.127 | 2.65 | 2.69 |
| 4 | constant depth | 0.012 | 0.134 | 0.129 | 2.68 | 2.60 |
| 5 | constant depth | 0.012 | 0.205 | 0.122 | 2.44 | 2.18 |
| 6 | constant depth | 0.012 | 0.240 | 0.145 | 1.81 | 1.36 |

In another embodiment, the outer surface of the ball is divided by a plane that passes through the geometric center of the golf ball and divides the outer surface into a first hemisphere and a second hemisphere, wherein the first hemisphere has an arrangement of star shaped dimples and grooves, and the second hemisphere has an arrangement of dimples and grooves that is substantially identical to the arrangement of the first hemisphere.

In a particular aspect of this embodiment, each hemisphere comprises star shaped dimples in an amount of at least 40, or from 40 to 60. In a more particular aspect of this embodiment, each hemisphere comprises 50 star shaped dimples.

Each hemisphere optionally includes one or more dimples having a conventional plan shape, e.g., a circular plan shape, in addition to the star shaped dimples. In a particular aspect of this embodiment, each hemisphere comprises at least 25, or at least 50, or at least 60, dimples having a conventional, e.g., circular, plan shape.

In another particular aspect of this embodiment, each hemisphere comprises grooves in an amount of at least 5, or from 5 to 10. In a more particular aspect of this embodiment, each hemisphere comprises 6 grooves.

Referring now to FIGS. 2A-2C, a golf ball outer surface is illustrated having substantially identical hemispheres, each of which consists of 50 star shaped dimples, 70 spherical dimples, and 6 grooves, the grooves being represented by shading in FIGS. 2B-2C. Each of the star shaped dimples has a plan shape defined by a stellated pentagon, an encompassing diameter of 0.080 inches, and a plan shape area of 0.0018 $in^2$. Each of the star shaped dimples has a flat bottom profile shape and a dimple depth, as measured along a ball radius from the phantom surface of the ball to the deepest point on the dimple, of 0.0042 inches. The spherical dimples have an edge angle of 14.75° and include dimples having the following dimple diameters: 0.110 inches, 0.130 inches, 0.150 inches, 0.160 inches, 0.170 inches, and 0.185 inches. Each of the grooves has a plan shape defined by a curved path, and are separated from each other by land area that is similar in width to the grooves. The width of each groove varies along the length of the groove. In a further particular aspect of the embodiment shown in FIGS. 2A-2C, the grooves of the second hemisphere have properties as given in Table 2 below.

TABLE 2

| Groove | Profile Shape | Depth (in) | Max Width (in) | Min Width (in) | First Edge Length (in) | Second Edge Length (in) |
|---|---|---|---|---|---|---|
| 1 | constant depth | 0.010 | 0.078 | 0.075 | 1.40 | 1.47 |
| 2 | constant depth | 0.010 | 0.078 | 0.076 | 1.52 | 1.56 |
| 3 | constant depth | 0.010 | 0.078 | 0.076 | 1.59 | 1.61 |
| 4 | constant depth | 0.010 | 0.078 | 0.076 | 2.69 | 2.66 |
| 5 | constant depth | 0.010 | 0.078 | 0.076 | 2.62 | 2.55 |
| 6 | constant depth | 0.010 | 0.078 | 0.076 | 2.46 | 2.36 |

Golf balls of the present invention may have a flat parting line or a non-flat parting line.

Golf ball dimple patterns of the present invention may include conventional dimples, including, but not limited to, spherical dimples, catenary dimples, and the like, in addition to stellated polygon shaped dimples.

Unique Overall Golf Ball Color Appearance

Advantageously, a novel overall golf ball color appearance can be produced by pre-selecting and coordinating the individual color appearances of each of the dimples, grooves, and land surfaces within two hemispheres of covers of golf balls of the invention.

In one such embodiment, the golf ball of the invention has a plurality of dimples and a plurality of grooves on the outer surface thereof, wherein the outer surface may be divided by a dividing plane that passes through the geometric center of the golf ball and divides the outer surface into a first hemisphere and a second hemisphere. The first hemisphere may comprise at least 40 dimples having a stellated polygon plan shape, and not including any grooves; and the second hemisphere may comprise at least 5 grooves, and not including any dimples having a stellated polygon plan shape.

Additionally, the land surface of the first hemisphere has a first color appearance that contributes to an overall golf ball color appearance, and the land surface of the second hemisphere has a second color appearance that contributes to the overall golf ball color appearance. Each dimple of the first hemisphere may have a third color appearance that contributes to the overall golf ball color appearance; and each groove of the second hemisphere may have a fourth color appearance that contributes to the overall golf ball color appearance. The overall golf ball color appearance of the finished golf ball is therefore comprised of the first color appearance, the second color appearance, the third color appearance and the fourth color appearance.

Figure 9:
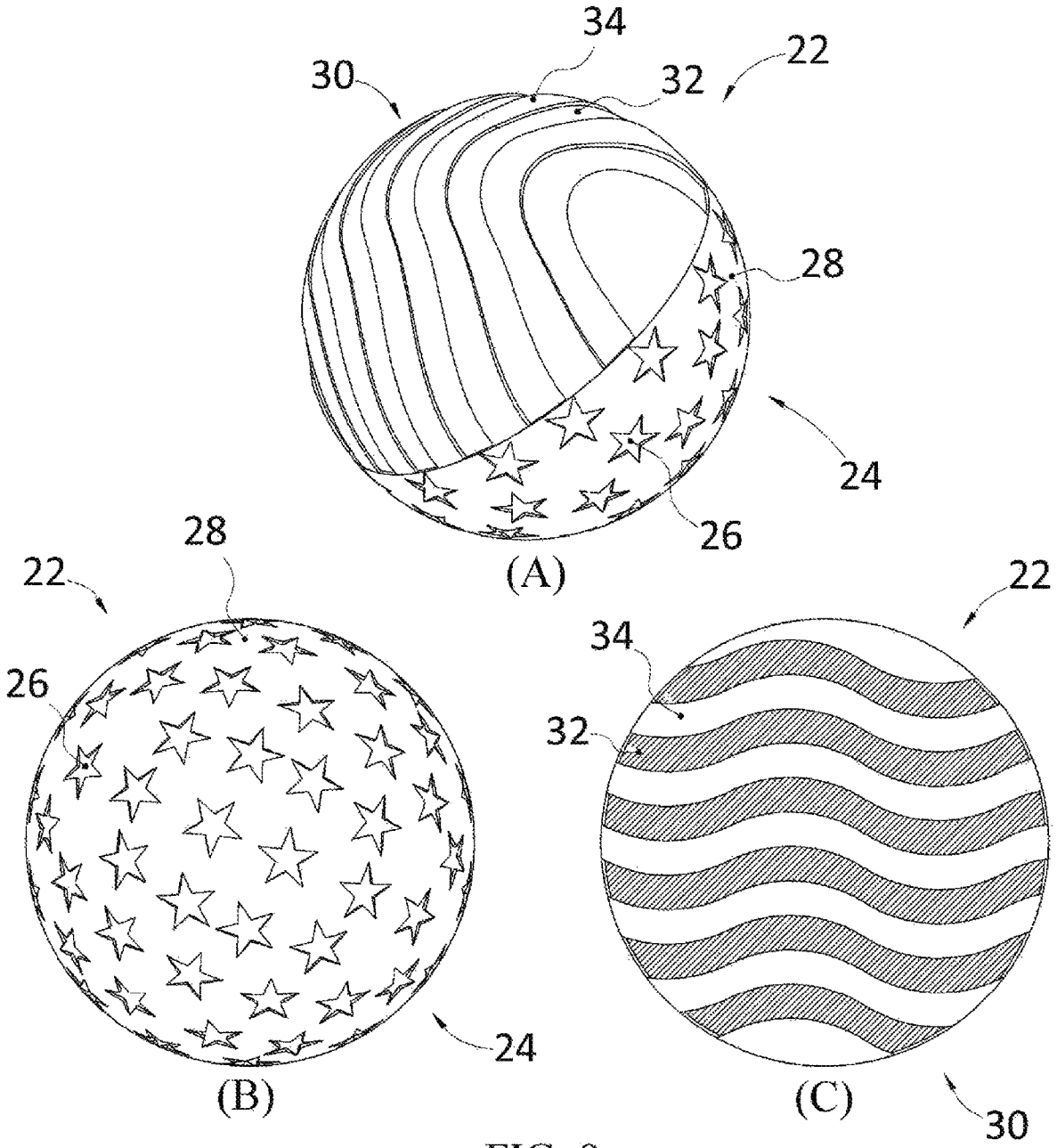
FIGS. 9A-9C illustrate plan views of a golf ball having a dimple and grooves pattern wherein the color appearances of dimples, grooves and land surfaces are pre-selected and coordinated to produce a unique overall golf ball color appearance.

For example, FIGS. 9A-9C depict plan views of a golf ball 22 having a dimple pattern according to one embodiment of the present invention incorporating color appearances which contribute to an overall golf ball color appearance. Different views 9A, 9B, and 9C collectively represent an overall golf ball color appearance wherein a first hemisphere 24 of the ball consists of both stellated polygon shaped dimples, each having color appearance 26, and land surfaces, each having a color appearance 28. Meanwhile, a second hemisphere 30 consists of both grooves, each having a color appearance 32 and formed within land surfaces having color appearance 34. For example, in one such embodiment, land surface color appearance 28 may be blue-colored, and land surface color appearance 34 may be red-colored, while both of stellated polygon shaped dimples color appearance 26 and grooves color appearance 32 are white. Of course, embodiments are envisioned wherein stellated polygon shaped dimples color appearance 26 and grooves color appearance 32 differ. Furthermore, it is also envisioned that stellated polygon shaped dimples color appearance 26 may be multi-colored, such as wherein at least some of the stellated polygon shaped dimples have different color appearances as between each other; and in turn, wherein at least some of the grooves have different color appearances as between each other In golf balls of the invention, pre-selected color appearances for each of the unique land, dimple and grooves arrangements collectively create a unique and desirable overall golf ball color appearance without negatively impacting the golf ball's physical properties and playing characteristics. As used herein, the term "color appearance" refers without limitation to any visually apparent suitable pigment(s), dye(s), tint(s), paint(s), structured colors, and/or other medium having/producing a pre-selected hue, saturation and chroma.

In this regard, the "hue" of a given color appearance means which visible color, whether spectral or non-spectral, a particular shade, pigment, dye, tint, etc. a particular surface portion of the golf ball resembles most closely. That is, whether the apparent color of the specific surface portion may be generally categorized as being red, yellow, blue, green, orange, purple, pink, etc.

For example, various hues within the wavelengths of visible light include Violet: 380-450 nm (688-789 THz frequency); Blue: 450-495 nm; Green: 495-570 nm; Yellow: 570-590 nm; Orange: 590-620 nm; Red: 620-750 nm (400-484 THz frequency. However, numerous other envisioned hues are not present in the spectrum because they are the result of our eyes' mixing wavelengths of light. For example, pinks are produced by mixing red with various amounts of white or violet wavelengths; while blueish greens are produced by mixing green with various amounts of blue; greenish blues are produced by mixing various amounts of green with blue, etc. White is what we see when all wavelengths of light are reflected off an object. Black, on the other hand, is what our eyes see in a space that reflects very little light at all.

Meanwhile, the term "saturation" refers to how pure a color is—that is, the dominance of the particular hue in the color. A color's saturation is not dependent on how dim or bright the independent surface lighting is. Instead, a color's saturation may be reduced by reducing the dominance of the hue in the color. Thus, a golf ball's overall golf ball color is directly influenced by predetermining the saturation of at least one color appearance that contributes to the overall golf ball color appearance, notwithstanding the particular hue and/or the chroma.

In turn, the term "chroma" represents the strength of a surface color. Unlike saturation, a color's chroma is dependent on lightness. For a given saturation, chroma will be greatest at intermediate lightness levels and will be zero at both maximum and minimum lightness levels (which ranges from black to white). And chroma will be greater for the hue "red" than for the hue "brown' at a constant lightness value. In fact, two surfaces may have the same saturation or intensity yet higher chroma if one surface gives off more light than the other under the same conditions.

Thus, in golf balls of the invention, in some embodiments, two given color appearances may have the exact same hues, and yet differ due to differing saturations and/or chromas.

In yet other embodiments, two given color appearances may have different hues and therefore differ notwithstanding their respective saturations and/or chromas. In still other embodiments, two given color appearances may have different hues and even further differentiate due to differing saturations and/or chromas.

In one embodiment, the first color appearance is different than the second color appearance. In a specific such embodiment, the first color appearance may be blue-colored, and the second color appearance may be red-colored.

In a particular such embodiment, each of the third color appearance and the fourth color appearance may be different than both of the first color appearance and second color appearance. In a specific such embodiment, each of the third color appearance and the fourth color appearance is white.

In another particular such embodiment, the third color appearance is the same as the second color appearance, and the fourth color appearance is the same as first color appearance.

In a different embodiment, the first color appearance may be the same as the second color appearance. In a different embodiment, the first color appearance may be the same as the second color appearance. In one such specific embodiment, the third color appearance is different than the first color appearance. In another such specific embodiment, the third color appearance is the same as the second color appearance, and the fourth color appearance is the same as first color appearance. In yet another such specific embodiment, the fourth color appearance is different than second color appearance. These specific embodiments are mutually exclusive of each other.

In still another such embodiment, each of the third color appearance and the fourth color appearance is different than both of the first color appearance and the second color appearance.

In a particular embodiment, the at least one of the color appearances creating the overall golf ball color appearance comprises a colored coating that is painted on the first hemisphere and/or the second hemisphere.

In another particular embodiment, each of the grooves has a plan shape defined by a curved path.

In yet another particular embodiment, each of the dimples having a stellated polygon plan shape has an encompassing diameter of from 0.20 inches to 0.35 inches.

In still another particular embodiment, each of the dimples having a stellated polygon plan shape has a ratio, $$\frac{D1}{D2},$$

of the encompassing diameter, D1, to the interior diameter, D2, of from 2 to 5.

In one preferred embodiment, each of the grooves has a depth of from 0.007 inches to 0.017 inches, as measured along a ball radius from the phantom surface of the ball to the deepest point of the groove.

Alternatively, a golf ball of the invention may have a plurality of dimples and a plurality of grooves on the outer surface thereof, wherein the outer surface can be divided by a dividing plane that passes through the geometric center of the golf ball and divides the outer surface into a first hemisphere and a second hemisphere having the following properties: the first hemisphere has an arrangement of dimples and grooves comprising 50 dimples having a stellated polygon plan shape and 6 grooves, wherein the dimples and grooves do not overlap or touch, and the second hemisphere has an arrangement of dimples and grooves that is substantially identical to the arrangement of the first hemisphere. Additionally, the land surface of the first hemisphere has a first color appearance that contributes to an overall golf ball color appearance and the land surface of the second hemisphere has a second color appearance that contributes to the overall golf ball color appearance; and each dimple of the first hemisphere has a third color appearance that contributes to the overall golf ball color appearance, and each dimple of the second hemisphere has a fourth color appearance that contributes to the overall golf ball color appearance; and each groove of the first hemisphere has a fifth color appearance that contributes to the overall golf ball color appearance, and each groove of the second hemisphere has a sixth color appearance that contributes to the overall golf ball color appearance. The overall golf ball color appearance of the finished golf ball is comprised of the first color appearance, the second color appearance, the third color appearance, the fourth color appearance, the fifth color appearance and the sixth color appearance.

In one such embodiment, the first color appearance is the same as the second color appearance. In another such embodiment, the first color appearance is different than the second color appearance. In yet another such embodiment, the third color appearance is the same as the fourth color appearance. In still another such embodiment, the third color appearance is different than the fourth color appearance. In a further embodiment, the fifth color appearance is the same as the sixth color appearance. In an alternative embodiment, the fifth color appearance is different than the sixth color appearance.

Of course, embodiments are indeed also envisioned wherein multiple opposing color appearances have the same hues, saturations and chromas. For example, the first, second, third, and fourth color appearances may all have the same hues, saturations and chromas, while the fifth and sixth color appearances differ from each of the first, second, third, and fourth color appearances with respect to at least one of hue, saturation and/or chroma. Or, the third, fourth, fifth and sixth color appearances may all have the same hues, saturations and chromas, while the first and second color appearances differ from each of the third, fourth, fifth and sixth color appearances with respect to at least one of hue, saturation and/or chroma. Or, the first, second, fifth and sixth color appearances may all have the same hues, saturations and chromas, while the third and fourth color appearances differ from each of the first, second, fifth and sixth color appearances with respect to at least one of hue, saturation and/or chroma.

The first and second hemispheres may be formed/created about a subassembly in several ways to produce golf balls of the invention. For example, the first and second hemispheres may be molded about a subassembly via compression molding. Compression molds typically include multiple pairs of mold cavities, each pair comprising first and second mold cavities that mate to form a spherical recess for holding the core or other subassembly. In one such compression molding process, first colored and second colored cover materials can be pre-formed into a first half-shell having a first color appearance, and second half-shell having a second color appearance. The half-shells are placed into a pair of compression mold cavities, and the core or other subassembly is then placed between the half-shells before closing the mold. The core and cover combination is then exposed to heat and pressure, which causes the cover half-shells to combine and form a full cover. The first hemisphere of this resulting cover has the first color appearance, while the second hemisphere has the second color appearance—which can be the same color, or differ—but neither of which is white.

The golf ball is then painted entirely white so as to coat the entire surface. Subsequently, the paint on the frets/land surface is removed via, for example, a Gleber or a centerless grinding operation whereby a thin layer of the fret/land surface is removed to reveal the underlying fret/land surface first and second color appearances. In such embodiments, the resulting golf ball has an overall golf ball color appearance that is comprised of the first color appearance, the second color appearance, and white. In a specific such embodiment, each of the first hemisphere and second hemisphere comprises an ionomeric material, and one of the hemispheres is red-colored, while the other hemisphere is blue-colored, producing a golf ball having an overall color appearance comprised of red, white and blue.

In another embodiment, the golf ball cover is a cast urethane, urea or urethane/urea hybrid wherein a first hemisphere of the cover has a first color appearance and a second hemisphere has a second color appearance. Casting is a common method of producing a urethane, urea or urethane/urea hybrid outer layer about a core or other subassembly.

In a casting process, a first castable composition having a first color appearance is introduced into a first mold cavity of a given pair of mold half shells. The core/subassembly is then either placed directly into the composition or is held in position (e.g., by an overhanging vacuum or suction apparatus) to contact the material in what will be the spherical center of the mold cavity pair. Once the first castable composition is at least partially cured (e.g., to a point where the core will not substantially move), a second castable composition having a second color appearance is introduced into a second mold cavity of each pair, and the mold is closed. The closed mold is then subjected to heat and pressure to cure the composition, thereby forming the outer layer about the core. The mold cavities can have a negative dimple pattern to impart dimples in the first and second compositions during the molding process where the cast layer is a cover, for example wherein the cover is comprised of the first color appearance and the second color appearance. It is important that a core/subassembly be centered in the castable compositions within a mold cavity before the mold halves are mated because a non-centered core/subassembly can create and result in undesirable playing characteristics.

Following casting, paint can be applied on the entire outer surface, following by removing the paint on the frets/land surface via, for example, the Gleber or a centerless grinding operation to reveal the underlying fret/land surface color(s). Once again, in such embodiments, the resulting golf ball has an overall golf ball color appearance that is comprised of the first color appearance, the second color appearance, and white.

Additionally, the first and second hemispheres may be formed/created about a subassembly via injection molding—such as injection molding a thermoplastic TPU or ionomer cover about the subassembly. For example, first and second mold cavities may be provided. Each mold cavity may have an arcuate inner surface defining an inverted predetermined dimple, groove and land surface pattern as defined herein. The first and second mold cavities collectively create a mold having an interior spherical cavity for holding a subassembly when mated together. A subassembly may be provided there between, secured there within using a plurality of retractable pins; and two differently colored polymeric compositions (e.g., TPU or ionomer) may be injected into the interior spherical cavity about the golf ball sub-assembly to mold a cover layer thereabout about and form a molded golf ball having an outer surface with the predetermined dimple, groove and land surface pattern, wherein an entire first half of the cover has the first color appearance, and an entire second half of the cover has the second color appearance.

In embodiments wherein the land surfaces of different hemispheres have different color appearances than the dimples and grooves, a colorant having third and fourth color appearances may be applied in discrete locations on arcuate inner surface defining inverted dimples before molding, and a so that when first and second colored cover compositions are provided into the mold adjacent at least one of these colorants, the color material applied on each inverted dimple and on each inverted groove is transferred to the cover material and incorporated into the molded cover surface when a cover molding process is performed.

In either embodiment, the retractable pins are withdrawn before molding is finished, and then the upper mold cavity and lower mold cavity are separated and the molded golf ball may be removed from the mold.

Alternatively, star dimples and/or grooves may be painted to impart a different color appearance than the material of the land surface areas post-molding.

In a different embodiment, the arcuate inner surface of a mold half produces a first hemisphere of the cover comprising at least 40 dimples having a stellated polygon plan shape and does not include any grooves, and the arcuate inner surface of a second mold half produces a second hemisphere of the cover comprising at least 5 grooves and does not include any dimples having a stellated polygon plan shape; wherein the land surface of the first hemisphere has a first color appearance that contributes to an overall golf ball color appearance and the land surface of the second hemisphere has a second color appearance that contributes to the overall golf ball color appearance; and each dimple of the first hemisphere has a third color appearance that contributes to the overall golf ball color appearance; and each groove of the second hemisphere has a fourth color appearance that contributes to the overall golf ball color appearance; such that the overall golf ball color appearance of the finished golf ball is comprised of the first color appearance, the second color appearance, the third color appearance and the fourth color appearance Additional possible methods for manufacturing a golf ball of the invention include molding a cover about a subassembly having a first color appearance (e.g. white), followed by rolling a first half of the outer surface of the golf ball in a second colored paint (e.g. blue) such that the fret/land surface of half of the golf ball has the color appearance of the second colored paint; and rolling a second half of the outer surface of the golf ball in a third colored paint (e.g. red) such that the fret/land surface of half of the golf ball has the color appearance of the third colored paint.

In some embodiments, the dimples and grooves can be masked while the fret/land surface is painted, followed by removing the masking from the dimples and grooves after painting the fret/land surface.

It is also envisioned that first and second durable yet thin films, each mirroring the dimple arrangement of one hemisphere the golf ball outer surface and having a predetermined dimples, grooves and land surface pattern of half of the dimpled cover outer surface may be thermoformed about the hemisphere to produce a single thin coating layer that provides a pre-determined color appearances within the golf ball's outer surface and creating an overall golf ball color appearance.

The terms land area, land surface(s) and fret surface(s) are used interchangeably herein.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of dimples and a plurality of grooves on the outer surface thereof, wherein the outer surface can be divided by a dividing plane that passes through the geometric center of the golf ball and divides the outer surface into a first hemisphere and a second hemisphere having the following properties:

the first hemisphere comprises at least 40 dimples having a stellated polygon plan shape and does not include any grooves, and the second hemisphere comprises at least 5 grooves and does not include any dimples having a stellated polygon plan shape;

wherein land surface of the first hemisphere has a first color appearance that contributes to an overall golf ball color appearance and land surface of the second hemisphere has a second color appearance that contributes to the overall golf ball color appearance; and each dimple of the first hemisphere has a third color appearance that contributes to the overall golf ball color appearance; and each groove of the second hemisphere has a fourth color appearance that contributes to the overall golf ball color appearance;

such that the overall golf ball color appearance of the finished golf ball is comprised of the first color appearance, the second color appearance, the third color appearance and the fourth color appearance.

2. The golf ball of claim 1, wherein the first color appearance is different than the second color appearance.

3. The golf ball of claim 2, wherein the first color appearance is blue-colored and the second color appearance is red-colored.

4. The golf ball of claim 2, wherein each of the third color appearance and the fourth color appearance is different than both of the first color appearance and second color appearance.

5. The golf ball of claim 4, wherein each of the third color appearance and the fourth color appearance is white.

6. The golf ball of claim 2, wherein the third color appearance is the same as the second color appearance, and the fourth color appearance is the same as first color appearance.

7. The golf ball of claim 1, wherein the first color appearance is the same as the second color appearance.

8. The golf ball of claim 7, wherein the third color appearance is different than the first color appearance.

9. The golf ball of claim 7, wherein the fourth color appearance is different than second color appearance.

10. The golf ball of claim 7, wherein each of the third color appearance and the fourth color appearance is different than both of the first color appearance and the second color appearance.

11. The golf ball of claim 1, wherein at least one of the color appearances creating the overall golf ball color appearance comprises a colored coating that is painted on at least a portion the first hemisphere and/or the second hemisphere.

12. The golf ball of claim 1, wherein each of the grooves has a plan shape defined by a curved path.

13. The golf ball of claim 1, wherein each of the dimples having a stellated polygon plan shape has an encompassing diameter of from 0.20 inches to 0.35 inches.

14. The golf ball of claim 1, wherein each of the dimples having a stellated polygon plan shape has a ratio, $$\frac{D1}{D2},$$

of the encompassing diameter, D1 to the interior diameter, D2, of from 2 to 5.

15. The golf ball of claim 1, wherein each of the grooves has a depth of from 0.007 inches to 0.017 inches, as measured along a ball radius from the phantom surface of the ball to the deepest point of the groove.

16. A golf ball having a plurality of dimples and a plurality of grooves on the outer surface thereof, wherein the outer surface can be divided by a dividing plane that passes through the geometric center of the golf ball and divides the outer surface into a first hemisphere and a second hemisphere having the following properties:

the first hemisphere has an arrangement of dimples and grooves comprising 50 dimples having a stellated polygon plan shape and 6 grooves, wherein the dimples and grooves do not overlap or touch, and the second hemisphere has an arrangement of dimples and grooves that is substantially identical to the arrangement of the first hemisphere;

wherein land surface of the first hemisphere has a first color appearance that contributes to an overall golf ball color appearance and land surface of the second hemisphere has a second color appearance that contributes to the overall golf ball color appearance; and each dimple of the first hemisphere has a third color appearance that contributes to the overall golf ball color appearance, and each dimple of the second hemisphere has a fourth color appearance that contributes to the overall golf ball color appearance; and each groove of the first hemisphere has a fifth color appearance that contributes to the overall golf ball color appearance, and each groove of the second hemisphere has a sixth color appearance that contributes to the overall golf ball color appearance;

such that the overall golf ball color appearance of the finished golf ball is comprised of the first color appearance, the second color appearance, the third color appearance, the fourth color appearance, the fifth color appearance and the sixth color appearance.

17. The golf ball of claim 16, wherein the first color appearance is the same as the second color appearance.

18. The golf ball of claim 16, wherein the first color appearance is different than the second color appearance.

19. The golf ball of claim 16, wherein the third color appearance is the same as the fourth color appearance.

20. The golf ball of claim 16, wherein the fifth color appearance is the same as the sixth color appearance.

* * * * *